US011384553B2

(12) United States Patent
Cross et al.

(10) Patent No.: US 11,384,553 B2
(45) Date of Patent: Jul. 12, 2022

(54) SWIMMING POOL CONSTRUCTION

(71) Applicant: MP HYDRO PTY LIMITED, New South Wales (AU)

(72) Inventors: Anthony Mark Cross, New South Wales (AU); Charles Eric Rickard, New South Wales (AU)

(73) Assignee: MP HYDRO PTY LIMITED, New South Wales (AU)

( * ) Notice: Subject to any disclaimer, the term of this patent is extended or adjusted under 35 U.S.C. 154(b) by 0 days.

(21) Appl. No.: 17/268,823

(22) PCT Filed: Aug. 16, 2019

(86) PCT No.: PCT/AU2019/050857
§ 371 (c)(1),
(2) Date: Feb. 16, 2021

(87) PCT Pub. No.: WO2020/034006
PCT Pub. Date: Feb. 20, 2020

(65) Prior Publication Data

US 2022/0136267 A1 May 5, 2022

(30) Foreign Application Priority Data

Aug. 16, 2018 (AU) ..... 2018903010
May 6, 2019 (AU) ..... 2019203161

(51) Int. Cl.
*E04H 4/00* (2006.01)
*E04H 4/14* (2006.01)

(52) U.S. Cl.
CPC ..... *E04H 4/0037* (2013.01); *E04H 4/141* (2013.01); *E04H 2004/0068* (2013.01)

(58) Field of Classification Search
CPC ..... E04H 4/0037; E04H 4/141; E04H 2004/0068
(Continued)

(56) References Cited

U.S. PATENT DOCUMENTS 3,208,084 A 9/1965 Collins et al.
3,555,575 A 1/1971 Schwarz et al.
(Continued)

FOREIGN PATENT DOCUMENTS

EP 1319775 A1 6/2003
FR 3049630 A1 10/2017
GB 1228458 A 4/1971

*Primary Examiner* — Huyen D Le
(74) *Attorney, Agent, or Firm* — Edwin A. Sisson, Attorney at Law, LLC; Jeffrey J. Banyas

(57) ABSTRACT

A pool shell including a wall, a floor and a region of curvature running along a bottom of the wall and connecting the wall to the floor. A fastener-receiving formation, on an exterior of the region of curvature is for rigidly connecting the bottom to a support. Also discussed is a swimming pool including a pool shell, having a wall and two or more upright supports. The wall has a top, a bottom, a first elongate stiffening portion and an exterior. The upright supports are spaced along the exterior. The first elongate stiffening portion runs along the wall and is positioned more than 250 mm from each of the top and the bottom. Each of the upright supports are rigidly connected to the first elongate stiffening portion and at least one of the top and the bottom, and predominantly formed of elongate rigid members.

14 Claims, 8 Drawing Sheets

(58) Field of Classification Search
USPC ..... 4/488
See application file for complete search history.

(56) References Cited

U.S. PATENT DOCUMENTS

| | | | | |
|---|---|---|---|---|
| 3,820,174 | A | 6/1974 | Rozanski | |
| 5,010,603 | A | 4/1991 | Hertzog | |
| 5,727,264 | A * | 3/1998 | Craig | E04H 4/144 4/489 |
| 6,367,099 | B1 | 4/2002 | Contrino et al. | |
| 2009/0172873 | A1* | 7/2009 | Ludlow | E04H 4/0037 4/506 |
| 2009/0188034 | A1 | 7/2009 | Gardenier | |
| 2012/0054955 | A1* | 3/2012 | Laughlin | E04H 4/0012 4/506 |
| 2013/0328464 | A1 | 12/2013 | Hall | |
| 2019/0136561 | A1* | 5/2019 | Khamis | E04H 4/0037 |

* cited by examiner

SWIMMING POOL CONSTRUCTION

PRIORITIES AND CROSS REFERENCES

This Application claims priority from International Application No. PCT/AU2019/050857 filed on 16 Aug. 2019, Australian Application No. 2018903010 filed on 16 Aug. 2018, and Australian Application No. 2019203161 filed on 6 May 2019 the teachings of each of which are incorporated by reference herein in their entirety.

FIELD OF THE INVENTION

The invention relates to swimming pools.

BACKGROUND TO THE INVENTION

A swimming pool is a vessel for holding a volume of water sufficient for swimming.

Some swimming pools are formed of concrete applied in liquid form (with suitable reinforcement, etc.) and allowed to set in situ. Various surface finishes such as tiles are applied to provide the pool with an attractive interior.

Another mode of construction entails a freely pliable impermeable liner supported by a steel frame. This mode of construction is relatively inexpensive although the end result is less attractive. The pliable liner billows out between the frame members and generally appears to be flimsy.

Another approach entails the installation of a pool shell. A pool shell is a semi-rigid liner that when properly installed can be just as attractive as a concrete pool.

Pool shells are typically formed of fiber-reinforced polymer known as fiberglass, often in the vicinity of 5.5 mm thick. The initial applicant's pool shells are often in the range of 6 mm to 10 mm thick. In the context of a pool shell, 10 mm thick fiberglass is relatively flexible. As such pool shells must be carefully installed to produce a pool that is attractive and robust.

Pool shells are frequently installed 'in ground'. This entails manipulating bulk material by digging a hole that is larger than the shell, placing the shell and then carefully backfilling thereabouts. As such, the earth and/or any groundwater supports the pool shell against the hydrostatic pressure of the water within the pool.

Some pool shells can also be installed 'above ground' (or partly above ground as in the context of installation in a hillside).

To suit such above ground installations, pool shells have been created with large vertical tubular ribs formed about their exterior. To install the pool shell, the site is first leveled and a trench encircling the site is excavated. The shell is then placed and leveled prior to concrete being supplied to each of the vertical ribs whereby the trench and ribs are filled with a single continuous body of concrete so that when the concrete sets an integral solid body of concrete defines a ring footing and a respective concrete finger within each of the vertical ribs.

Pool shells are typically formed by applying layers of material to a male mold. Typically the first layer is a gel coating that has an attractive appearance when the shell is pulled from the mould. Forming the tubular ribs to suit above ground installation is time consuming and expensive. Typically a shell akin to a typical 'in ground shell' must be produced and then cardboard rib-defining forms individually cut and placed about the exterior of the shell before the shell is returned for an additional series of fibreglassing operations to form the fiberglass about the exterior of the cardboard forms.

With the foregoing in mind, the present invention aims to provide improvements in and for swimming pools or at least to provide alternatives for those concerned with swimming pools.

It is not admitted that any of the information in this patent specification is common general knowledge, or that the person skilled in the art could be reasonably expected to ascertain or understand it, regard it as relevant or combine it in any way before the priority date.

SUMMARY

One aspect of the invention provides a swimming pool including a pool shell having a wall;

two or more upright supports spaced along an exterior of the wall; and mechanical fasteners fastening the upright supports to the shell;

the wall having a top, a bottom and a first elongate stiffening portion;

the first elongate stiffening portion running along the wall and being positioned more than 250 mm from each of the top and the bottom; and the uprights supports being rigidly connected to the first elongate stiffening portion and at least one of the top and the bottom.

Preferably each of the upright supports is rigidly connected to the top and the bottom.

The pool shell may include a floor;

a region of curvature running along a bottom of the wall and connecting the wall to the floor; and a fastener-receiving formation, on an exterior of the region of curvature, for rigidly connecting the bottom to a support.

Another aspect of the invention provides a shell including a wall;

a floor;

a region of curvature running along a bottom of the wall and connecting the wall to the floor; and a fastener-receiving formation, on an exterior of the region of curvature, for rigidly connecting the bottom to a support.

The shell may be nestable. Preferably the fastener-receiving formation is not lower than an exterior of the floor.

Another aspect of the invention provides a swimming pool including the shell; and two or more upright supports;

the wall having

- a top,
- an exterior, and
- a first elongate stiffening portion running along the wall and positioned more than 250 mm from each of the top and the bottom;

the upright supports being spaced along the exterior;

each of the upright supports being rigidly connected to the bottom and at least one of

- the top, and
- the first elongate stiffening portion.

Optionally each of the upright supports is predominantly formed of elongate rigid members.

Another aspect of the invention provides a swimming pool including a pool shell having a wall; and two or more upright supports;
the wall having a top, a bottom, a first elongate stiffening portion and an exterior;
the upright supports being spaced along the exterior;
the first elongate stiffening portion running along the wall and being positioned more than 250 mm from each of the top and the bottom;
each of the upright supports being
rigidly connected to the first elongate stiffening portion and at least one of the top and the bottom, and
predominantly formed of elongate rigid members.

Preferably mechanical fasteners fasten the upright supports to the shell.

The pool shell may be a molded pool shell. The pool shell may be a fibre-reinforced polymer pool shell.

The supports may be metallic. Alternatively they may be plastic.

Preferably each of the one or more supports at least mostly consists of elongate portions of substantially constant cross-section. Most preferably the supports are arranged to engage the first elongate stiffening portion at three or more locations spaced along the first elongate stiffening portion.

Another aspect of the invention provides a method, of preparing a site for a swimming pool, including
manipulating bulk material to produce a surface; and
placing panels on the surface.

The manipulating bulk material to produce a surface may be levelling bulk material to produce a level surface.

Optionally the panels each have
a top and
a bottom compliant relative to the top.

Each of the panels may include plywood.

Each of the panels may include polystyrene.

Preferably the panels cover at least most of a margin encircling a contact patch of the swimming pool. The panels may define an opening substantially encircling the contact patch. The method may include supplying free-draining material to fill the opening level to a top surface of the panels.

Another aspect of the invention provides a method of installing a swimming pool including placing a pool shell on a site.

The method may include rigidly connecting supports to an exterior of the pool shell.

Another aspect of the invention provides a method of installing a swimming pool;
an in situ pool shell being substantially at a final position of the shell and having a wall;
the wall having a top, a bottom, a first elongate stiffening portion and an exterior;
the an elongate stiffening portion running along the wall and being positioned more than 250 mm from each of the top and the bottom;
the method including
spacing upright supports along the exterior of the in situ pool shell;
fastening upright supports to a wall of the in situ pool shell such that upright supports are rigidly connected to the elongate stiffening portion and at least one of the top and the bottom.

The fastening preferably includes applying mechanical fasteners.

Another aspect of the invention provides a set, of panels, for paving a site for a swimming pool;
at least one of the panels defining a void for routing at least one line for the swimming pool.

Preferably the panels each have a top and a bottom compliant relative to the top. The panels include plywood and/or polystyrene. Most preferably, the panels are configured to define an opening substantially encircling a contact patch of the swimming pool.

Another aspect of the invention provides a set, for a swimming pool installation, including a swimming pool and the set of panels.

Another aspect of the invention provides a swimming pool including
a pool shell; and
one or more supports;
the pool shell having a first wall and a second wall;
the first wall having a top, a bottom and a first elongate stiffening portion;
the first elongate stiffening portion running along the first wall and being positioned more than 250 mm, e.g. more than 500 mm, from each of the top and the bottom of the first wall;
the second wall opposing the first wall;
each of the one or more supports
being rigid
running under the pool shell at least from the first wall to the second wall and
engaging the first elongate stiffening portion
to resist outward deformation of the first wall.

Pool shells may have trim, such as tiled finishes, within 250 mm of the top which may to some extent stiffen the walls. This aspect of the invention incorporates an elongate stiffening portion below this region to stiffen the wall.

The first elongate stiffening portion may comprise a ledge within the pool shell. The swimming pool may include a capping portion running along an exterior of the pool shell and capping an internal corner under the ledge to, together with the ledge, define a tubular portion running along the first wall.

Preferably each of the one or more supports engages the coping of the first wall. Most preferably each of the one or more supports extends upwardly behind the second wall. Optionally each of the one or more supports engages a coping of the second wall.

The second wall may have a top, a bottom a second elongate stiffening portion. The second elongate stiffening portion preferably runs along the second wall and is positioned more than 250 mm from each of the top and the bottom of the second wall. The supports may engage the second elongate stiffening portion to resist outward deformation of the second wall.

The swimming pool may be a transportable unit.

Another aspect of the invention provides a method, of manufacturing a swimming pool, including
applying bracing to align a first wall of a pool shell; and
engaging a rigid member with the first wall; and then
rigidly connecting the rigid member to at least one other rigid member to define a support for extending under the pool shell to resist outward deformation of the first wall; and then
removing the bracing.

The rigidly connecting may include welding.

The applying bracing to align may be applying bracing to hold straight.

BRIEF DESCRIPTION OF DRAWINGS

FIG. 8 is a perspective view of a layout of reinforcing frames;

FIG. 9 is a perspective view of a top cap;

FIG. 10 is a perspective view of support pads between the frames;

FIG. 11 is a perspective view of the addition of a cover strip;

FIG. 12 is a perspective view of a shell being lowered onto the frames;

FIGS. 13 and 14 are perspective views of the addition of plywood reinforcements;

FIG. 15 is a perspective view of a frame and the portion of the shell being brought together;

FIG. 16 schematically illustrates the shell being braced;

FIG. 17 is a perspective view of the placement of a support element;

DETAILED DESCRIPTION

Figure 1:
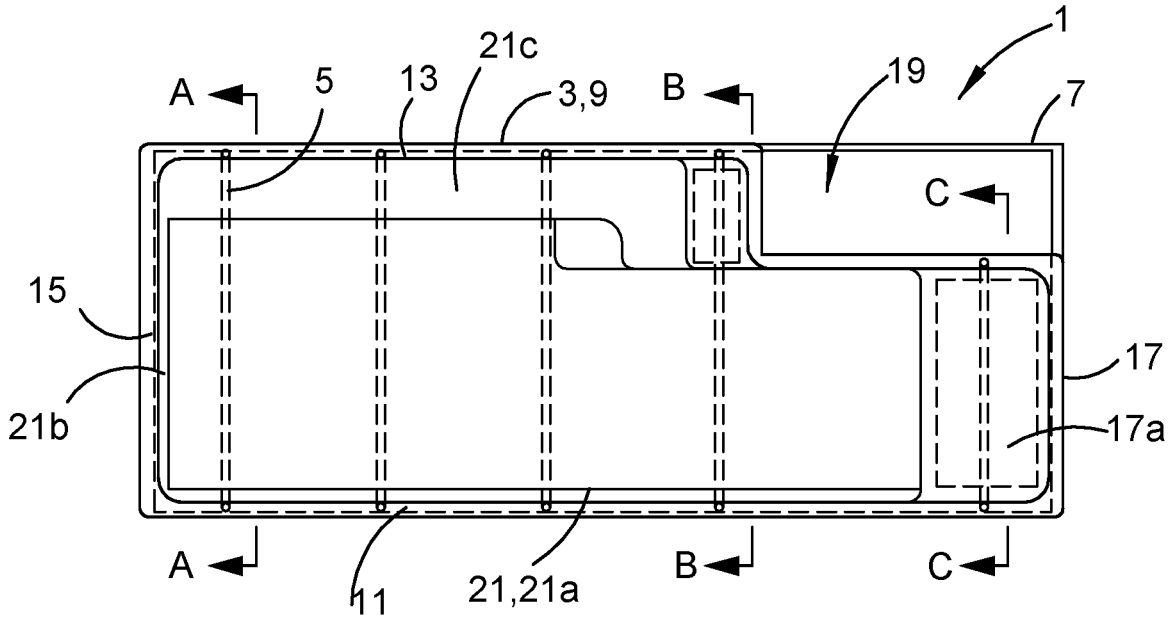
FIG. 1 is a plan view of a supported pool shell.
Figure 2:
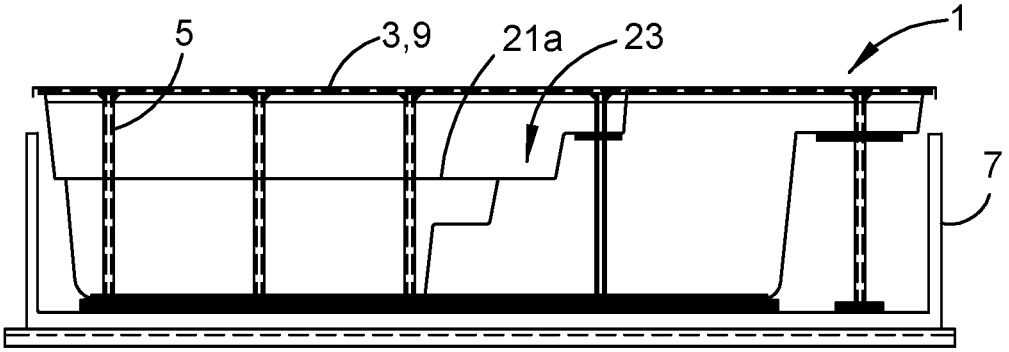
FIG. 2 is an elevation of the supported pool shell of FIG. 1.

FIG. 1 illustrates a swimming pool 1. The pool includes a shell 3, a set of supports 5 and a base tray 7. The shell 3 and supports 5 sit within the tray 7. The tray 7 has upright walls to improve the structures' aesthetics and provides a base by which the structure 1 is conveniently transportable as a transportable unit. Other variants of the presently disclosed technology may be structures which are not conveniently transportable as transportable units.

The shell 3 is an upwardly open vessel having coping 9 running about its perimeter. The coping 9 defines the top of the pool shell. As the word 'top' and similar wording is used herein, the top of a pool shell is the lowest point at which water might overflow the pool shell when the pool shell is in use, aside from minor features such as weirs to which spas might be attached. As 'bottom' and similar wording is used herein, the bottom of the pool shell is the highest point upon which a bather might stand aside from minor features such as beaches, ledges, steps and seats.

The shell 3 has a first wall 11 and a second wall 13 opposing the first wall 11. At one end of the shell the walls 11, 13 are mutually connected by a wall 15. At the other end of the shell the walls are connected by a wall 17 and stepped perimeter portion 19. A ledge 21 runs along the walls 11, 15, 13 and is in three parts. Ledge portion 21*a* runs along the wall 11 from the wall 15 to a beach area 17*a* at the other end of the pool. Ledge portions 21*b*, 21*c* run along the walls 15, 13 respectively. The ledge 21 is at a constant height in the vicinity of 650 mm from the top of the pool. Steps 23 are associated with the end of the wall 13 distal the wall 15.

The ledge portions 21*a*, 21*b* are 'step-ledges' about 75 mm wide. The ledge portion 21*c* is a shelf in the vicinity of 450 mm wide. The step ledges 21*a*, 21*b* provide a convenient standing point for children at the side of the pool whereas the ledge 21*c* provides a comfortable seating area.

In addition to providing convenient features within the pool, the ledge 21 stiffens the pool walls. The ledge 21*a* is an elongate portion running along the wall 11 to stiffen that wall against outward deformation under the influence of hydrostatic pressure. Likewise, the ledge portions 21*b*, 21*c* stiffen the walls 15, 13. The stiffener is preferably 500 mm to 700 mm from the top of the wall.

Figure 7:
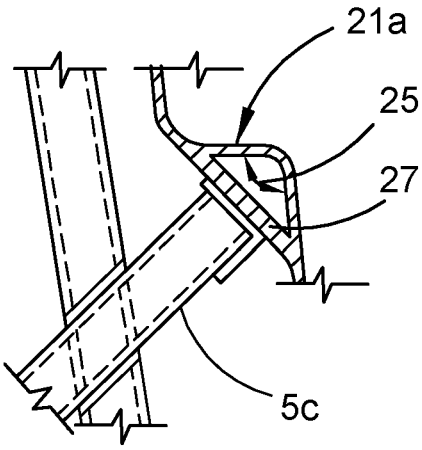
FIG. 7 is an enlargement of detail G in FIG. 3.

FIG. 7 shows the ledge 21*a* in further detail. In this particular example the internal corner 25 under the ledge 21*a* is capped by a capping piece 27 to define a tubular portion running along the wall 11. The ledge 21*a* and capping portion 27 thereby form part of a tubular stiffening portion. A stiffening portion is a portion that is stiffer than the bulk of the wall material. In this example the tubular portion is hollow. In other examples it might be filled by a suitable filling material e.g. the capping material 27 might be laid over a length of wood fitted within the corner 25.

Figure 3:
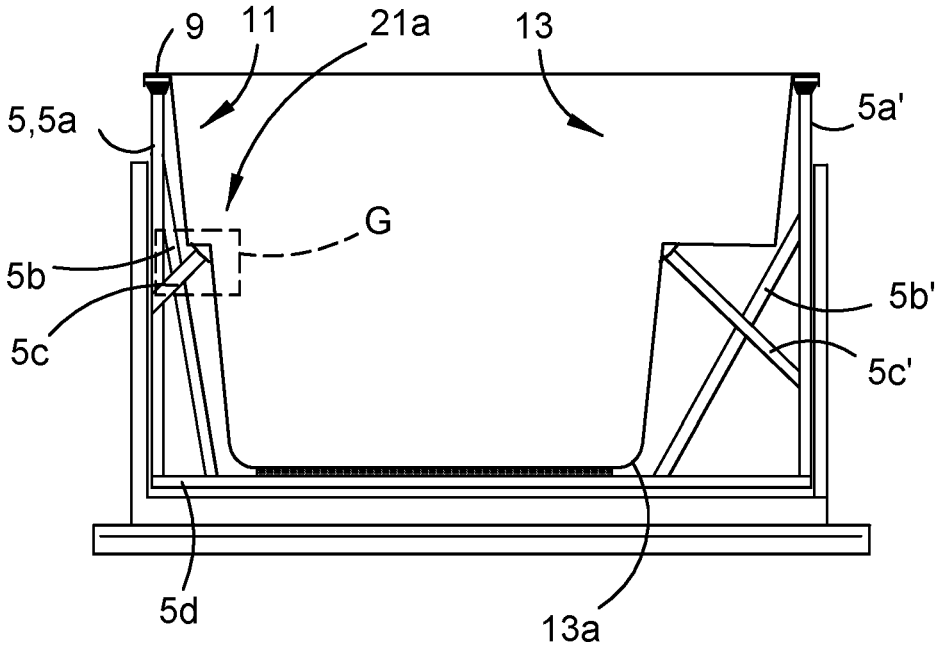
FIG. 3 is a cross-section view corresponding to the line A-A in FIG. 1.
Figure 4:
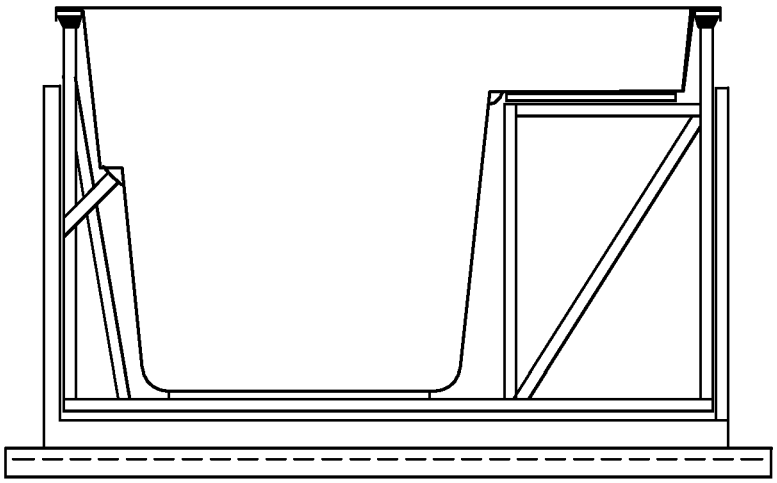
FIG. 4 is a cross-section view corresponding to the line B-B in FIG. 1.

The ledge portion 21*c* likewise stiffens the wall 13 and (as illustrated in FIGS. 3 and 4) is associated with a capping piece defining a tubular stiffening portion.

Whilst the ledge 21*a*, or more preferably the combination of ledge 21*a* and the capping piece 27, is a desirable form of stiffening formation, other stiffening formations are possible. By way of example, a suitable length of steel rectangular hollow section could be mounted to run along the exterior of the wall 11.

Figure 6:
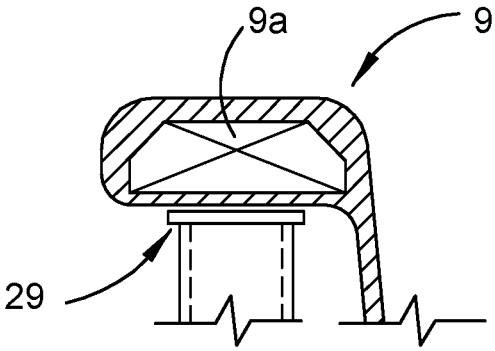
FIG. 6 is an enlargement of detail F in FIG. 5.

FIG. 6 illustrates the coping 9 in further detail. Advantageously the coping 9 is tubular. Most preferably it encapsulates material 9*a*, e.g. wood, into which screws can be engaged to fasten the top caps 29.

Advantageously the shell 3 can be constructed from a fiberglassing operation akin to the molding of a conventional 'in ground' shell followed by secondary operations to install the material 9 and capping piece 27, etc. These secondary operations are inexpensive relative to the previously described steps necessary to form the tubular concrete-receiving ribs.

The inventors have found that an above ground shell can be adequately supported by bracing the exterior of the shell with a suitable arrangement of supports e.g. with one or more weldments of steel e.g. steel RHS. Surprisingly good results can be achieved when the rigid supports are engaged with the elongate stiffening formation 21*a*, 27 spaced from the top and bottom of the wall. The engagement could be simple abutment although mutual fixation is preferred.

The inventors have also found that forming the rigid supports so as to wrap around under the pool is another important step towards cost-efficiently producing an aesthetically pleasing pool. As shown in FIG. 3, the rigid element 5 includes an upright member 5*a* running from the coping 9 down to a horizontal member 5*d*. Member 5*b* defines a diagonal brace mutually connecting the members 5*a*, 5*d*. Oblique member 5*c* connects the stiffening formation 21*a*, 27 to the members 5*a*, 5*b* of the element 5. The horizontal member 5*d* runs under the pool shell from the wall 11 to the corner 13*a* of the wall 13. This extension distributes the load applied to the element 5 via the capping piece 27. Indeed in this example the horizontal member 5*d* extends beyond the corner 13*a* to an arrangement of members 5*a*', 5*b*', 5*c*' akin to the members 5*a*, 5*b*, 5*c*. In this way, both walls 11, 13 are supported and tied together as a rigid unitary structure.

Figure 8:
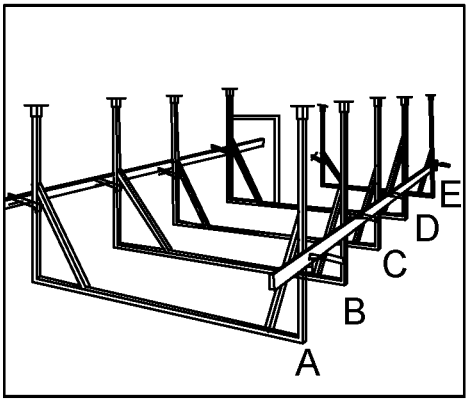
FIGS. 8 to 17 illustrate the reinforcement of a pool shell to form a supported pool shell.
Figure 9:
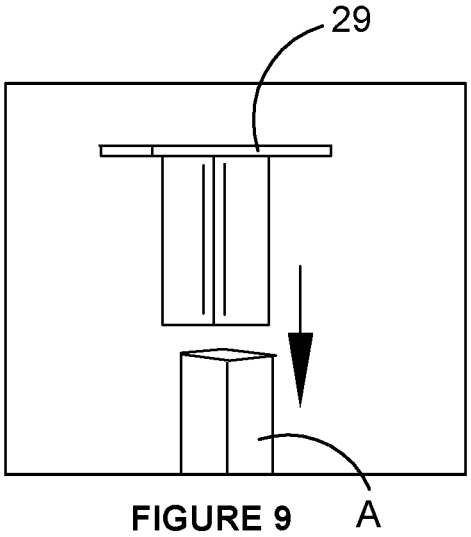
Figure 10:
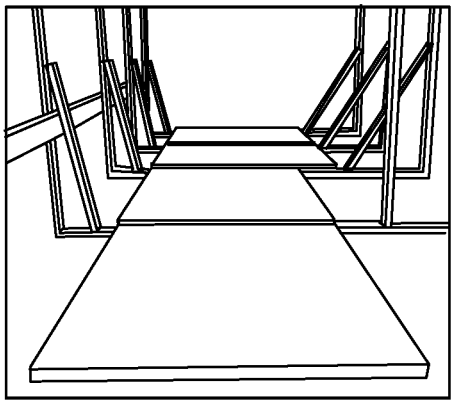

Once the shell 3 has been completed, frames A to E can be laid out as suggested in FIG. 8. In this example, each of the frames A to E is a respective weldment of 40×4 mm Square Hollow Section (SHS) having a galvanized finish. Top caps 29 are then added to the uprights of the frames. The top caps 29 are dimensioned to slide over the ends of the uprights. Each cap 29 has a pair of horizontal flanges, each of which has a screw hole.

Figure 11:
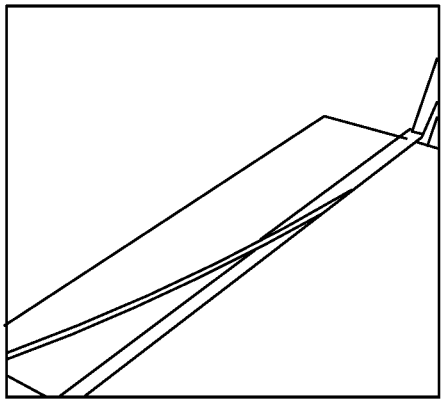

Sheets of suitably compliant material are then laid between the horizontals of the frames to underlie the shell 3. In this example the material is 50 mm thick polystyrene. The compliant material conforms to any imperfections (e.g. stones) on the surface onto which the structure 3, 5 is eventually placed and thereby avoids stress concentrations being applied to the shell 3. Preferably the sheet material is thicker than the horizontal portions of the frame are high and suitable covers of compliant material (e.g. 10 mm thick polystyrene strips) are adhered to the top of the horizontal members (FIG. 11) to separate the shell 3 from the horizontal members.

Figure 12:
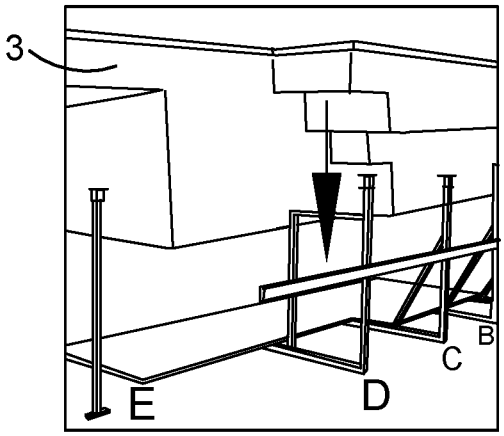
Figure 13:
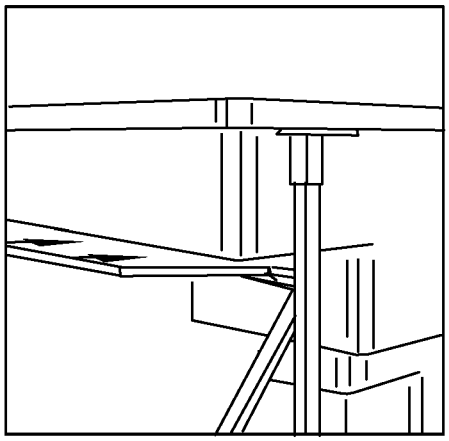
Figure 14:
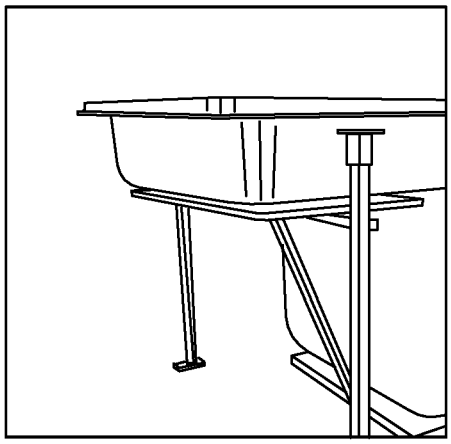

Glue is applied to compliant panels and the shell 3 is then lowered into the arrangement of frames (FIG. 12) and onto the glue. Support panels (e.g. plywood sheets) are then inserted to separate from the frames and support, the beach 17*a* and the stairs 23 (FIGS. 13 and 14).

Figure 5:
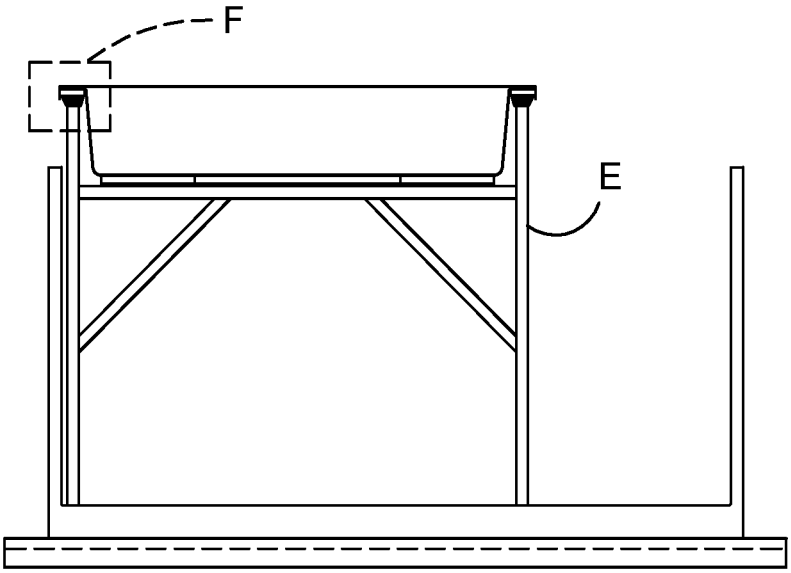
FIG. 5 is a cross-section view corresponding to the line C-C in FIG. 1.
Figure 15:
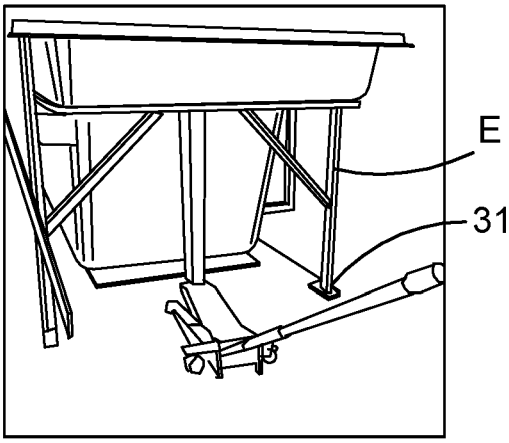

A frame E underlying the beach area 17*a* is then lifted into engagement with the beach area and its support panel (FIGS. 5 and 15).

Figure 16:
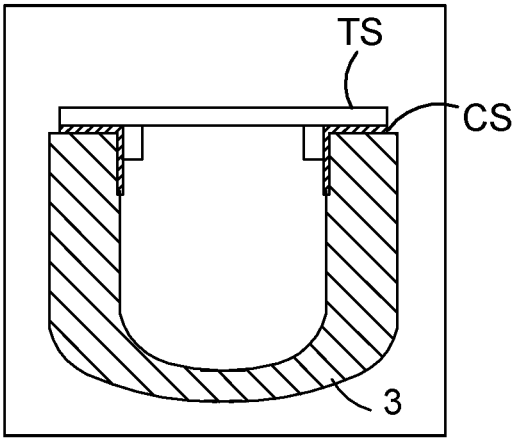
Figure 17:
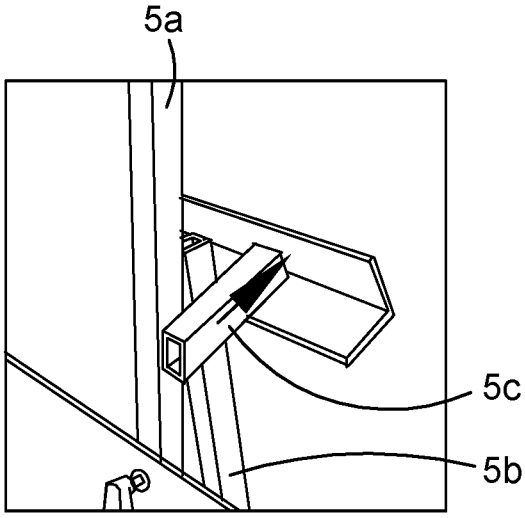
Figure 19:
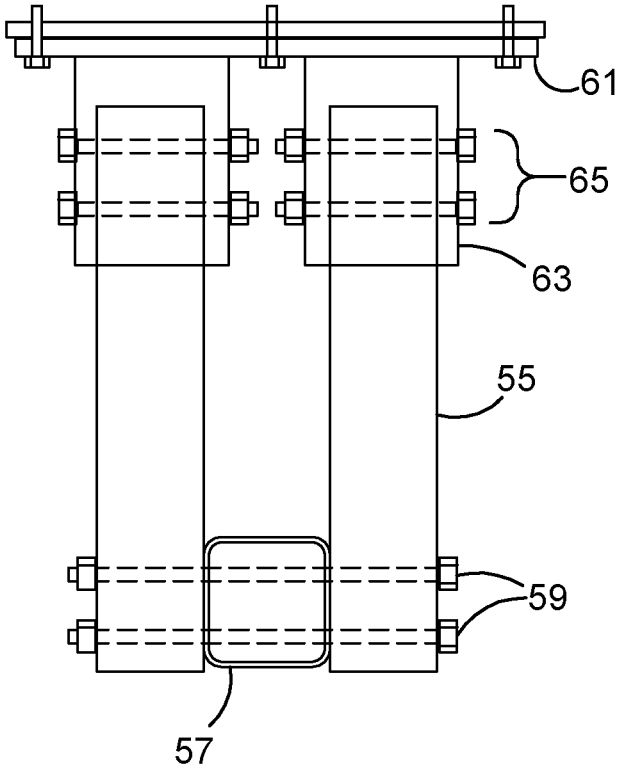
FIG. 19 is a horizontal cross-section reel of a support.
Figure 18:
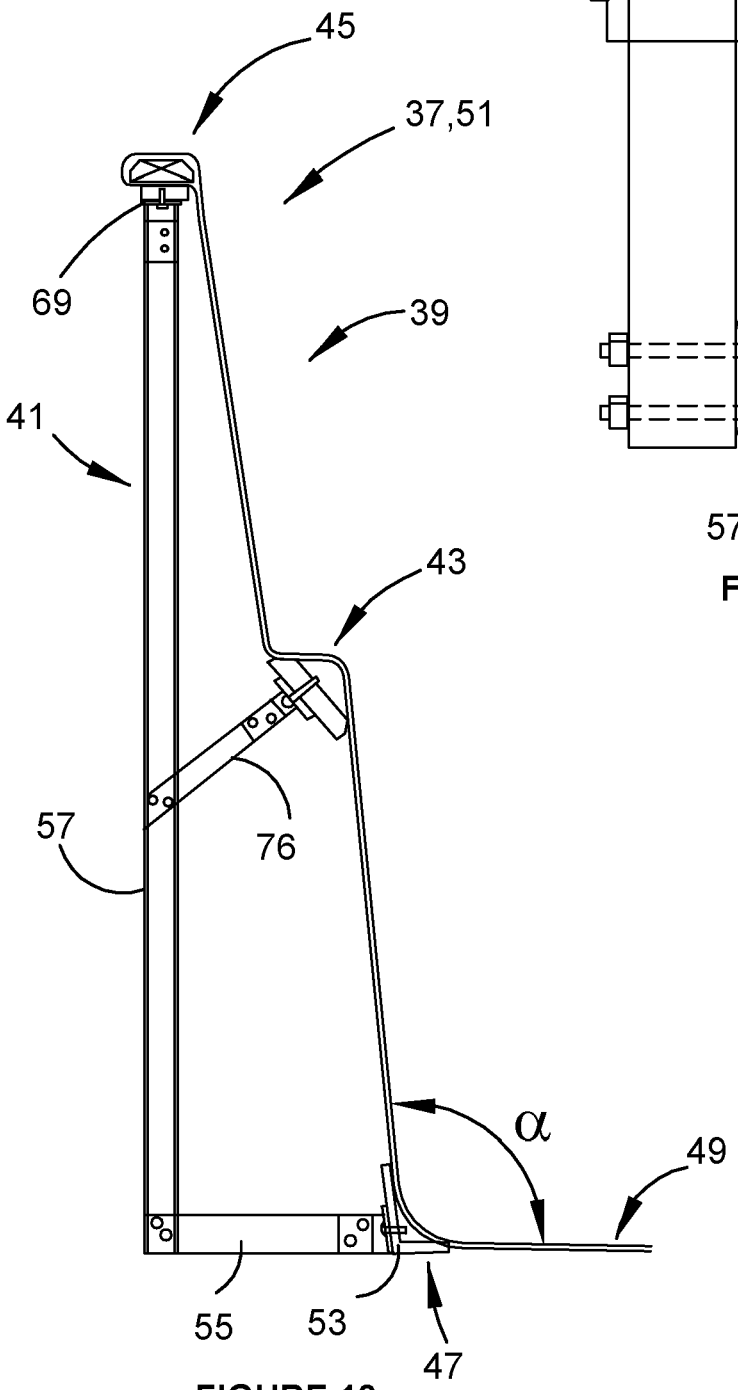
FIG. 18 is a vertical cross-section view of a wall.

The shell can then be braced to ensure proper alignment e.g. to hold the main walls 11, 13 straight. As schematically illustrated in FIG. 16, this may entail inserting a timber spacer TS into the pool shell 3 with suitable measures such as carpet strips CS to protect the gel coat.

With the shell in place, the caps 29 are then lifted (whilst remaining in sliding engagement with their respective uprights) and screwed into the coping 9. The caps 29 are then welded to their respective uprights to form uprights of the rigid supports (such as the upright 5*a* of the element 5). Feet 31 akin to the top caps 29 are likewise welded to the lower ends of the two uprights of the frame E (FIG. 15).

The supports 5*c* can then be placed. In this example each support 5*c* includes a length of 40×4 mm SHS supporting a length of angle iron at its pool engaging end. The angle iron is oriented to sit flat against the capping piece 27 and has a pair of screw holes via which the support 5*c* is screwed into that capping piece whilst the support 5*c* is properly oriented to be welded to the members 5*a*, 5*b* to form a single unitary rigid element 5.

The bracing TS, CS can then be removed to form a transportable structure 3, 5 that can be craned into the tray 7.

The pool 1 is well adapted for efficient manufacture in an industrial context and then efficient transport to the pool site. On the other hand, the present inventors have recognised that there is demand for the do-it-yourself (DIY) market, that is, for pools that can be supplied in kit form and assembled on site with minimal technical skill and without specialised equipment. Furthermore, the present inventors have recognised that the need for a crane to place the pool shell into the arrangement of frames (as in FIG. 12) is not desirable, particularly in a DIY context, and that pools that are easier to install also opens the way for retailers and others in the industry without the specialised skills of specialist pool installers to expand their businesses by competing with the pool installers.

FIGS. 18 to 21 illustrate aspects of an alternate swimming pool, and components therefor, better suited to the DIY market. The pool 37 has a pair of long opposed walls 39 braced by upright supports 41 spaced therealong. Preferred variants of the support 41 are attached to the step ledge 43 and to one or both of the top 45 and bottom 47 of the wall 39. The support 41 provides a reinforcing connection between relatively strong portions of the pool and thereby assists to maintain an aesthetically pleasing alignment of the wall 39. Preferably no portion of the support 41 runs under the floor 49 of the pool shell 51. Advantageously the support 41 is attached to the shell via mechanical fasteners, e.g. screws, bolts or rivets, etc. This enables the connections to be made by the home handyman with the shell in its final position, without a fibreglassing operation, although more preferably the pool 37 (including its supports 41, etc.) takes the form of a transportable unit that can be transported by road and lifted (e.g. craned) into place.

When the pool 37 is supplied in kit form, the elongate members 55, 57, 76 may be supplied as separate members (potentially as part of a common pack). Leaving the assembly of the support 41 to occur on site can reduce transport and assembly costs.

The support 41 is mechanically fastened, or more specifically screwed in this example, to each of the step ledge 43, top 45 and bottom 47. The step ledge 43 and top 45 are akin to the step ledge 21*a* and coping 9 of the pool 1.

The bottom 47 incorporates an additional fastener-receiving formation 53. The bottom of the wall 47 includes a radius connecting the wall 39 to the floor 49. The fastener-receiving formation is a formation additional to the typical wall thickness of the shell. In this example it takes the form of a perforated steel plate bent to an angle substantially corresponding to the angle between the floor and the lower portions of the wall 39. The plate is fibreglassed in place in the factory. In this example, the supports are spaced about 800 mm to 900 mm centres along the wall 39 and short fastener-receiving formations 53 have a complementary spacing along the corner 47 although in other variants the formation 53 may run the full length of the corner 47.

The formation 53 is to receive fasteners by which a foot 55 of the support 51 is mechanically fastened to the shell 51 and thereby rigidly connected to the bottom 47.

The formation 53 advantageously defines a distance into which fasteners can penetrate without projecting into the interior of the shell 51.

The formation 53 sits no lower than the bottom of the floor 49 and only millimetres outward of an exterior of the wall 39 which does not materially reduce the ability of the shells 51 to be stacked for interstate transport. Advantageously the shells are manufactured in one location, stacked for efficient transport over long distances and then removed from the stack and transported individually to the final site.

This example of the support 41 includes a pair of horizontal feet 55 formed of glass-reinforced polymer in the form of pultruded 100 mm×100 mm (or more preferably 76.2×76.2×6.4 mm) square hollow section. Other plastics and modes of construction, and indeed other rigid materials more generally, are possible. For example, the supports 41 may be formed of galvanized steel as in the supports 5 and vice versa.

The pair of horizontal legs 55 bracket a single upright 57. In this example the upright 57 takes the form of a single member of the same material as the legs 55. A pair of bolts 59 skewer and mutually fasten the three members. The inner ends of the legs 55 carry an adjustable mounting plate 61 by which the legs 55 are made length adjustable. The plate 61 includes a simple plate portion from which a pair of square sockets 63 project to receive the ends of the legs 55. Bolts 65 mutually connect the plate 61, 63 to the legs 55.

Preferably the plate 61 is attached to the fitting 53 before the bolt holes are drilled and the bolts 65 are placed to provide a degree of adjustability that takes up production variation, site variations and flexure of the components, etc. Other modes of length adjustment are possible. Preferably the shell 51 is aligned prior to the length of the adjustable length being set. This aligning operation may entail bracing akin to the process described in respect of the pool 1.

An inclined support 67 includes a pair of members akin to the members 55 and an adjustable plate akin to the plate 61 and connects step ledge 43 to the upright member 57. A top of the upright 57 is fitted with an adjustable plate 69 by which the member 57 is fastened to the top 45.

Advantageously, relative to the support arrangement of FIGS. 1 to 4, the supports 41 can be placed as required independently of any support called for on the other side of the pool. As such, the supports can be strategically located to make more efficient use of the available materials. By way of example, with reference to a pool akin to the pool 1 of FIG. 1, supports 41 might be spaced at 650 mm centres along the long run of wall 11 between wall 15 and beach 17*a*, whereas the portion of the wall 13 supported by the ledge 21*c* may be adequately supported by supports 41 and 900 mm centres. As such, the placement of the supports 41 may be more closely correlated with the inherent flexibility of the shell per se.

Preferably the pool is installed atop a concrete foundation, e.g. atop a slab or ring beam. Preferably the concrete is minimum 25 Mpa concrete.

Figure 20:
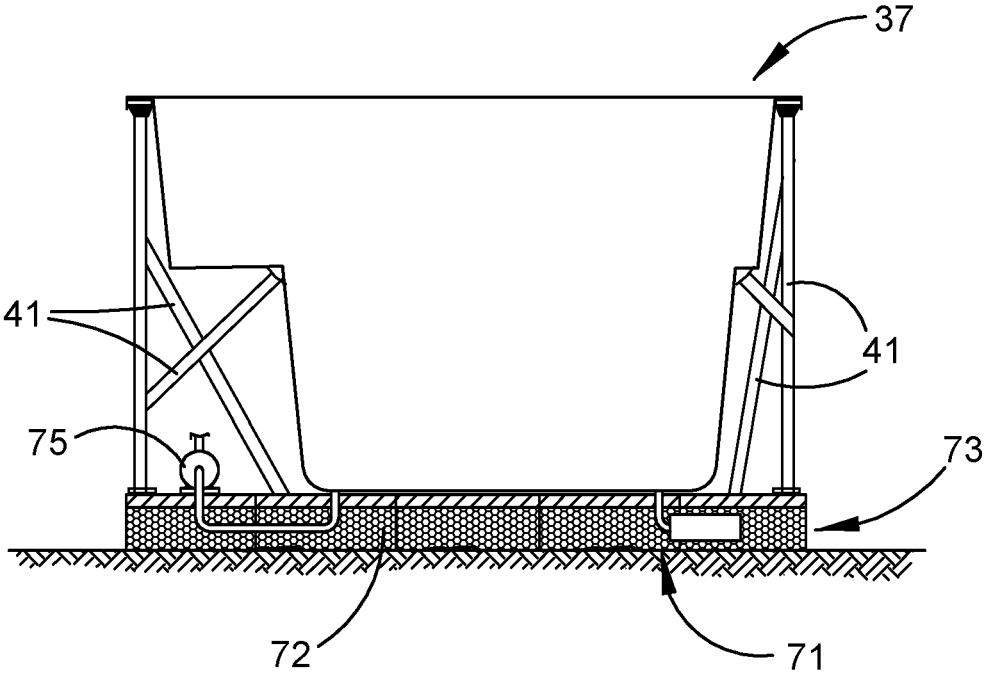
FIG. 20 is a vertical cross-section view of a swimming pool.
Figure 21:
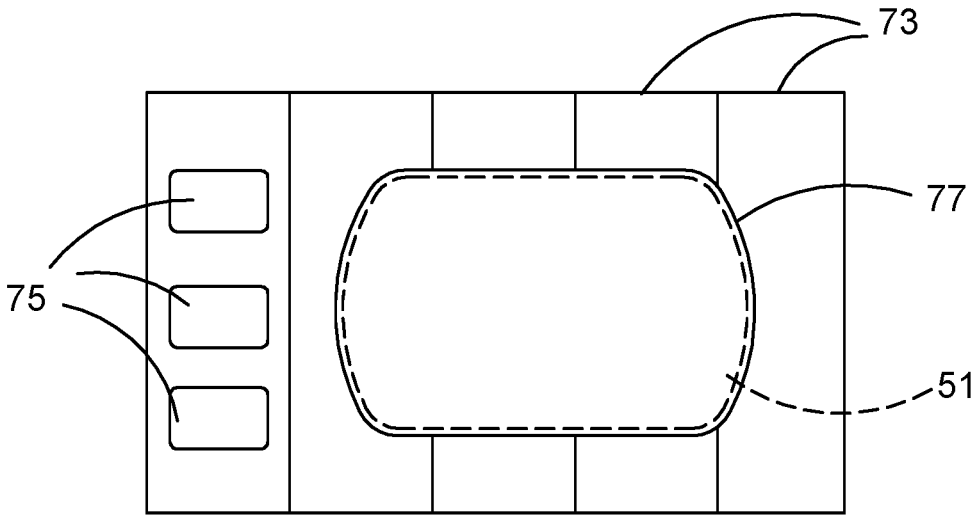
FIG. 21 is an elevation view of a site.

FIGS. 20 and 21 illustrate the swimming pool 37 and an alternative mode of site preparation.

As a first step bulk material (e.g. earth and road base) are manipulated to form a level pad 71. Preferably this entails digging out a small quantity of earth, applying a layer of road base and then compacting the material. In other applications, it may be necessary to build up material.

A set of panels 72 are then laid down on site. Advantageously the panels are dimensioned for convenient handling, e.g. are in the vicinity of 8'×4', and have a complaint base and a more rigid top. In this example, the base of each panel is formed of 50 mm thick extruded polystyrene (XPS) and is topped by a layer marine ply bonded to the polystyrene.

The compliant underside reduces deformations and associated stresses caused by imperfections in the surface 71 whilst the more rigid top provides support for the supports 41 and a convenient clean and dry mounting place for pool equipment 75 such as pumps filters and heaters.

Advantageously holes may be cut into the plywood and/or channels cut into the polystyrene to route lines such as electrical lines for powering underwater lights and various plumbing, e.g. plumbing for floor cleaning jets, to and from the interior of the pool.

The hydrostatic loadings on a pool shell vary dramatically depending on how it is installed. In true above ground installations wherein no portion of the shell is below the free surface of the ground, the panels 73 may define a substantially continuous deck underlying substantially all of the shell.

More often, the pool will be installed at least partly in ground and thereby potentially exposed to ground water pressure. To suit such installations preferably the panels 73 define an opening 77 corresponding to a footprint of the shell 51. Advantageously the panels 73 are supplied to site pre-cut for connection in a defined pattern (e.g. a defined pattern specified by markings on the panels and/or by supplied instructions) to define the opening 77.

Preferably free draining material for filing the opening 77 is supplied. Preferably at least the bulk of the free draining material is piled at a centre of the site prior to the boards being placed around it and then leveled off (and excess material removed and/or additional material added) to level off the free draining material in line with a top surface of the boards 73. The free draining material may be coarse sand but is preferably minus 7 mm gravel without fines.

Preferred variants of the pool are equipped with one or more hydrostatic relief valves arranged to receive water via the free draining medium to relieve hydrostatic pressure on the pool.

The pair of 100 mm wide members making up the foot 55 provide bearing area for transmitting force downwardly. In some cases, this area may be sufficient for the foot 55 to sit directly on bulk material, e.g. compacted road base. In other circumstances, the panels may be necessary or desirable to spread the load.

Figure 22:
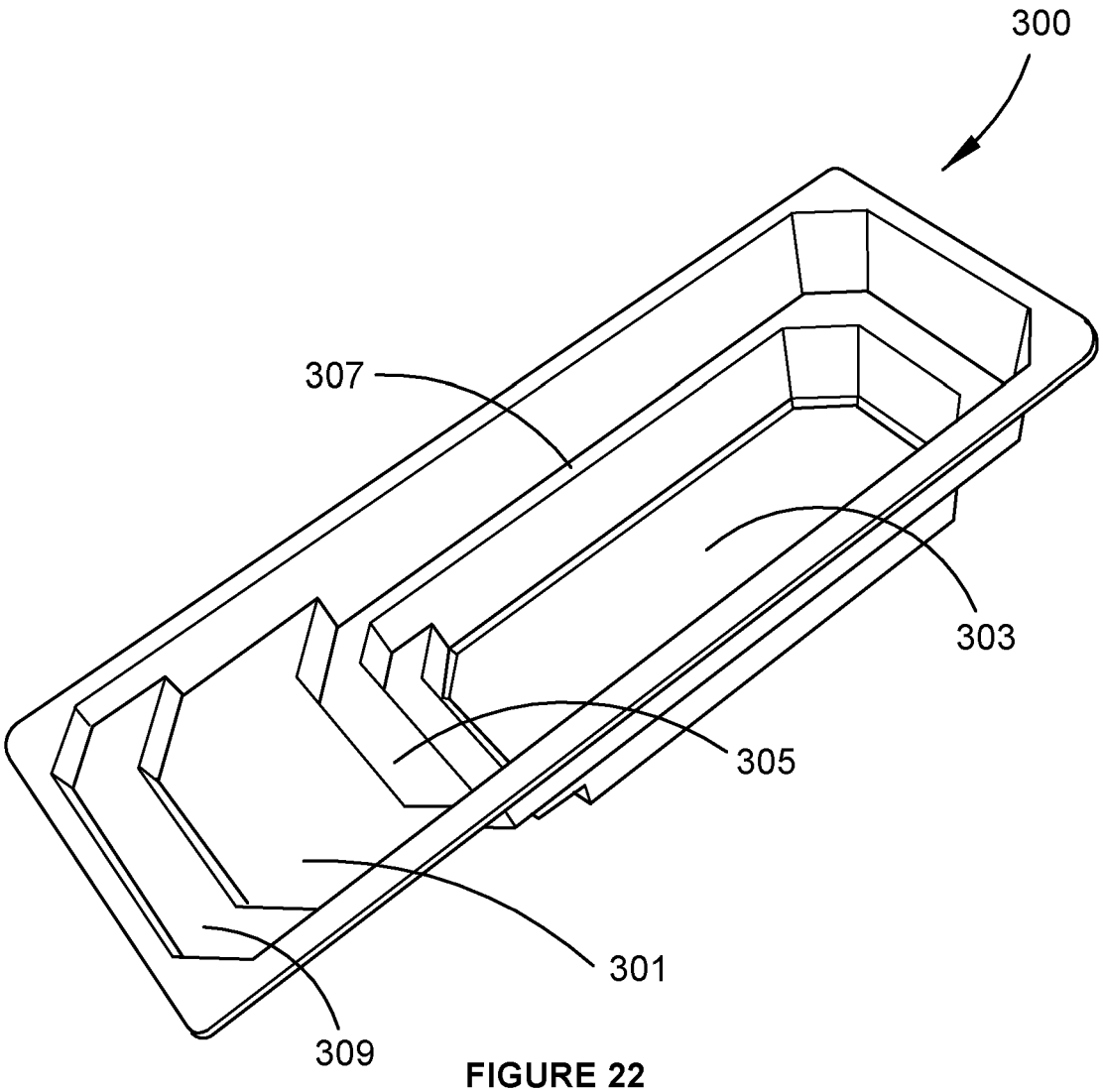
FIG. 22 is a perspective view of a pool shell.

FIG. 22 shows an example of a small pool shell suited to DIY installation in small backyards and courtyards etc. The shell 300 is in the vicinity of 6 m long by 2 m wide. It comprises a beach 301 and a deep end 303 mutually connected by steps 305. A step ledge 307 runs along each long side of the deep end 303 and together with one of the steps 305 and a similar step at the other end of the deep end 303 defines a single upward rectangular face surrounding the deep end 303. Step 309 is positioned to enable a bather to step into the pool and then onto the beach 301.

Whilst various examples are described, the invention is not limited to these examples. Rather the invention is defined by the claims.

The invention claimed is:

1. A swimming pool including a pool shell having a wall;

two or more upright supports spaced along an exterior of the wall; and mechanical fasteners fastening the upright supports to the shell;

the wall having a top, a bottom and a first elongate stiffening portion;

the first elongate stiffening portion running along the wall and being positioned more than 250 mm from each of the top and the bottom; and the uprights supports being rigidly connected to the first elongate stiffening portion and at least one of the top and the bottom.

2. The swimming pool of claim 1 wherein each of the upright supports is rigidly connected to the top and the bottom.

3. The swimming pool of claim 1 wherein the first elongate stiffening portion includes a ledge within the pool shell.

4. The swimming pool of claim 3 including a capping portion running along an exterior of the pool shell and capping an internal corner under the ledge to, together with the ledge, define a tubular portion running along the wall.

5. The swimming pool of claim 1 wherein the pool shell is a molded pool shell.

6. The swimming pool of claim 1 wherein the pool shell is a fibre-reinforced polymer pool shell.

7. The swimming pool of claim 1 wherein the supports are metallic.

8. The swimming pool of claim 1 wherein each of the one or more supports at least mostly consists of elongate portions of substantially constant cross-section.

9. The swimming pool of claim 1 wherein the supports are arranged to engage the first elongate stiffening portion at three or more locations spaced along the first elongate stiffening portion.

10. The swimming pool of claim 1 being a transportable unit.

11. The swimming pool of claim 1 wherein no portion of the upright supports runs under a floor of the pool shell.

12. The swimming pool of claim 1 comprising one or more hydrostatic relief valves.

13. A swimming pool being a transportable unit and comprising a molded fibre-reinforced polymer pool shell having a wall;

two or more upright supports spaced along an exterior of the wall; and mechanical fasteners fastening the upright supports to the shell;

the wall having a top, a bottom and a first elongate stiffening portion;

the first elongate stiffening portion running along the wall and being positioned more than 250 mm from each of the top and the bottom; and the uprights supports being rigidly connected to the first elongate stiffening portion, of the top and the bottom;

wherein the first elongate stiffening portion includes a ledge; and no portion of the upright supports runs under a floor of the pool shell.

14. The swimming pool of claim 13 comprising one or more hydrostatic relief valves.

* * * * *